US006053236A

United States Patent [19]

Judkins et al.

[11] Patent Number: 6,053,236

[45] Date of Patent: Apr. 25, 2000

[54] LENGTH ADJUSTABLE BOTTOMRAIL HAVING RELEASABLE LADDER RETAINER

[75] Inventors: Ren Judkins, 46 Newgate Rd., Pittsburgh, Pa. 15202; Thomas Reichner, Pittsburgh, Pa.

[73] Assignee: Ren Judkins, Pittsburgh, Pa.

[21] Appl. No.: 09/178,693

[22] Filed: Oct. 26, 1998

[51] Int. Cl.[7] ..... E06B 9/30

[52] U.S. Cl. ..... 160/168.1 R; 160/176.1 R; 160/178.3 R

[58] Field of Search ..... 160/168.1 R, 176.1 R, 160/178.3 R, 167 R, 172 R, 169 R, 279

[56] References Cited

U.S. PATENT DOCUMENTS

| | | | |
|---|---|---|---|
| 2,258,647 | 10/1941 | Haase | 160/178.3 R |
| 2,527,104 | 10/1950 | Schaefer | 160/178.3 R |
| 2,652,112 | 9/1953 | Walker | 160/173 |
| 2,783,831 | 3/1957 | Moyer | 160/173 |
| 4,177,852 | 12/1979 | Anderson et al. | 160/168 R |
| 4,621,673 | 11/1986 | Georgopoulos et al. | 160/168.1 R |
| 4,727,921 | 3/1988 | Vecchiarelli | 160/168.1 R |
| 4,739,816 | 4/1988 | Dodich et al. | 160/168.1 R |
| 5,573,051 | 11/1996 | Judkins | 160/168.2 |

FOREIGN PATENT DOCUMENTS

| | | |
|---|---|---|
| 1 252 878 | 10/1967 | Germany . |
| 1 509 182 | 12/1968 | Germany . |

*Primary Examiner*—Blair M. Johnson
*Attorney, Agent, or Firm*—Buchanan Ingersoll, P.C.

[57] ABSTRACT

In a venetian type blind the bottomrail incorporates a take-up system to increase or decrease the effective operating length of the venetian blind to fit a specific window length by allowing the effective operating portion of the ladders to be adjusted, with the unused portion of the ladders stored inside the bottomrail. The excess length of the ladders are pulled along the length of the bottomrail and can be pulled from the bottomrail to lengthen the blind after shortening. In one embodiment the ladders are attached to a slide that can be moved along the length of the bottomrail and positioned at any desired location. The slide may contain a series of hooks and can be attached to a pull cord that runs through a clamp in an end cap. In another embodiment a series of hooks are provided within the bottomrail to hold selected ladder rungs.

21 Claims, 4 Drawing Sheets

LENGTH ADJUSTABLE BOTTOMRAIL HAVING RELEASABLE LADDER RETAINER

FIELD OF INVENTION

The invention relates generally to a venetian type blind, and more particularly to a venetian type blind having a length adjustable bottomrail for customizing the length of the blind to fit windows of different lengths.

BACKGROUND OF THE INVENTION

Venetian type blinds have a series of slats hung on ladder cords which extend from a headrail to a bottomrail. Depending upon the width of the blind, two or more lift cords are provided. Usually, each lift cord is attached at one end to the bottomrail. The lift cords pass through elongated holes in the slats up to and through the headrail. A cord lock is usually provided in the headrail through which the lift cords pass. The cord lock allows the user to maintain the blind in any desired position from fully raised to fully lowered. The slats rest on rungs between the rails of the ladder cords. The blind is in an open position when the rungs are horizontal. To close most venetian blinds one lifts one rail while allowing the other rail to either remain in place or be lowered. Both the lift cords and the ladder cords are typically nonadjustably connected to the bottomrail.

In U.S. Pat. No. 5,573,051, there is shown a venetian type blind having slats that are notched to form slots on their inside edge and outside edge to accommodate the lift cords. The lift cords pass from the bottomrail to the headrail each passing through a slot on the inside edge or outside edge of each slat. At least two cord-type ladders are provided to hold the slats and are aligned such that the rails of the ladders are adjacent the lift cords and outside the slots cut in the slats. The slots are sized so that the lift cords and the ends of the rungs can loosely fit therein. Because lift cords travel within the slots provided in the slats no cord holes are needed in the slats.

It is known to customize venetian type blinds to fit windows of different sizes. Generally, a standard width blind which is closest to, but wider than, the window is selected to be modified. The headrail, bottomrail and slats are trimmed to fit the width of the window. To maintain symmetry, an equal amount is usually trimmed from each end of the slats. Since the length of the blind is adjustable by simply operating the lift cords, the length of the blind sometimes is not modified. Instead, a standard size blind which is nearest to, but longer than, the length of the window is chosen and the extra length is stacked on the bottomrail which rests on the window sill. However, this arrangement can be aesthetically unappealing and compromises the blind's closure when tilted. Equally unappealing is to simply remove the slats because the portion of the ladders which supported the removed slats would still remain. For the best appearance the blind should be nearly the same length as the window when fully extended. Any change in length should include shortening the ladders as well as removing slats.

In venetian type blinds the rails of ladders, which typically are cords but could be tape, and the lift cords can be attached to the bottomrail in different ways. One manner of attaching a ladder tape to a bottomrail is shown in U.S. Pat. No. 2,652,112 to Walker wherein the lift cord passes through small openings in the middle of each slat. The bottomrail has a hole completely through the top and the bottom surfaces. The opening in the top surface of the bottomrail is slightly narrower than the opening in the bottom surface. The lift cord is inserted through the narrower opening and a knot is formed in the end so that it cannot be pulled back through the narrower opening. The rails of the tape ladder encompass the bottomrail. A channel is provided longitudinally along one side of the bottomrail into which a portion of the tape rail can be folded. A pin is then inserted into the longitudinal channel over the tape rail to frictionally hold the tape rail to the longitudinal channel.

Anderson et al. in U.S. Pat. No. 4,177,853 show a manner of connecting the lift cord and a ladder cord to the bottomrail. In Anderson, the bottomrail has a longitudinal channel provided along the upper surface and a hole provided in the lower surface for each lift cord. A plug is provided in each hole. Each lift cord passes through small openings in the center of each slat, through the longitudinal channel and is connected to a plug. The cord rails pass outside of and adjacent to each side of the bottomrail and are then inserted up through the hole in the lower surface. The cord rails are frictionally held in the opening by the plug. Similarly, to Anderson, German Patent Nos. 1 252 878 and 1 509 182 each disclose a manner of attaching a lift cord and ladder cords to a bottomrail wherein a longitudinal channel is provided in the upper surface of the bottomrail and a hole is provided in the lower surface. In each case the lift cord passes through small openings in the middle of each slat, through the longitudinal channel and attaches to the plug. The cord rails pass outside of and adjacent to each side of the bottomrail and are then inserted up through the hole in the lower surface. The plug frictionally retains the cord rails in the hole. In each case the plug is frictionally retained in the hole and/or is held therein because of the attachment to the lift cord.

Theoretically, the bottomrails described in Anderson and the two German patents could be adjusted for the length of the blinds by removing excess slats, removing the plug, cutting off the excess slack in the cord rails, reinserting the ends of the cord rails up through the hole in the underside of the bottomrail, and then reinserting the plug to hold the cord rails in place. However, one problem with such a procedure is that repeated removal and insertion of the plug results in the fit between the hole and the plug becoming looser such that the cord rails may not be securely held in the hole. Another is that it takes a significant amount of time for the novice.

Accordingly, there is a need for venetian blind having a bottomrail that is readily adjustable so that the blind can be easily customized to fit windows of different lengths. Such a blind should overcome the disadvantages in the prior art by eliminating the stack of excess slats on the bottomrail and the excess ladder portions. Such a blind should permit repeated disconnection and reconnection of the lift cords and ladders without loosening or otherwise deteriorating the connections.

SUMMARY OF THE INVENTION

We provide a Venetian blind having a bottomrail, headrail and plurality of slats positioned therebetween. The bottomrail incorporates a take-up system to increase or decrease the effective operating length of the venetian blind to fit a specific window length by allowing the effective operating portion of the ladders to be adjusted, with the unused portion of the ladders stored inside the bottomrail. Several embodiments of methods to adjust ladder lengths are shown in the drawings. In one embodiment the ladders are attached to a slide that can be moved along the length of the bottomrail and positioned at any desired location. The slide may contain a series of hooks. In another embodiment a series of hooks are provided within the bottomrail to hold selected ladder rungs. In another embodiment the ladders are connected to a slide having a pull cord that runs through a clamp in an end cap. In all of these embodiments the excess length of the ladders are pulled along the length of the bottomrail and can be pulled from the bottomrail to lengthen the blind after shortening.

Other objects and advantages will become apparent from a description of the present preferred embodiments shown in the drawings.

DESCRIPTION OF THE PREFERRED EMBODIMENTS

Figure 1:
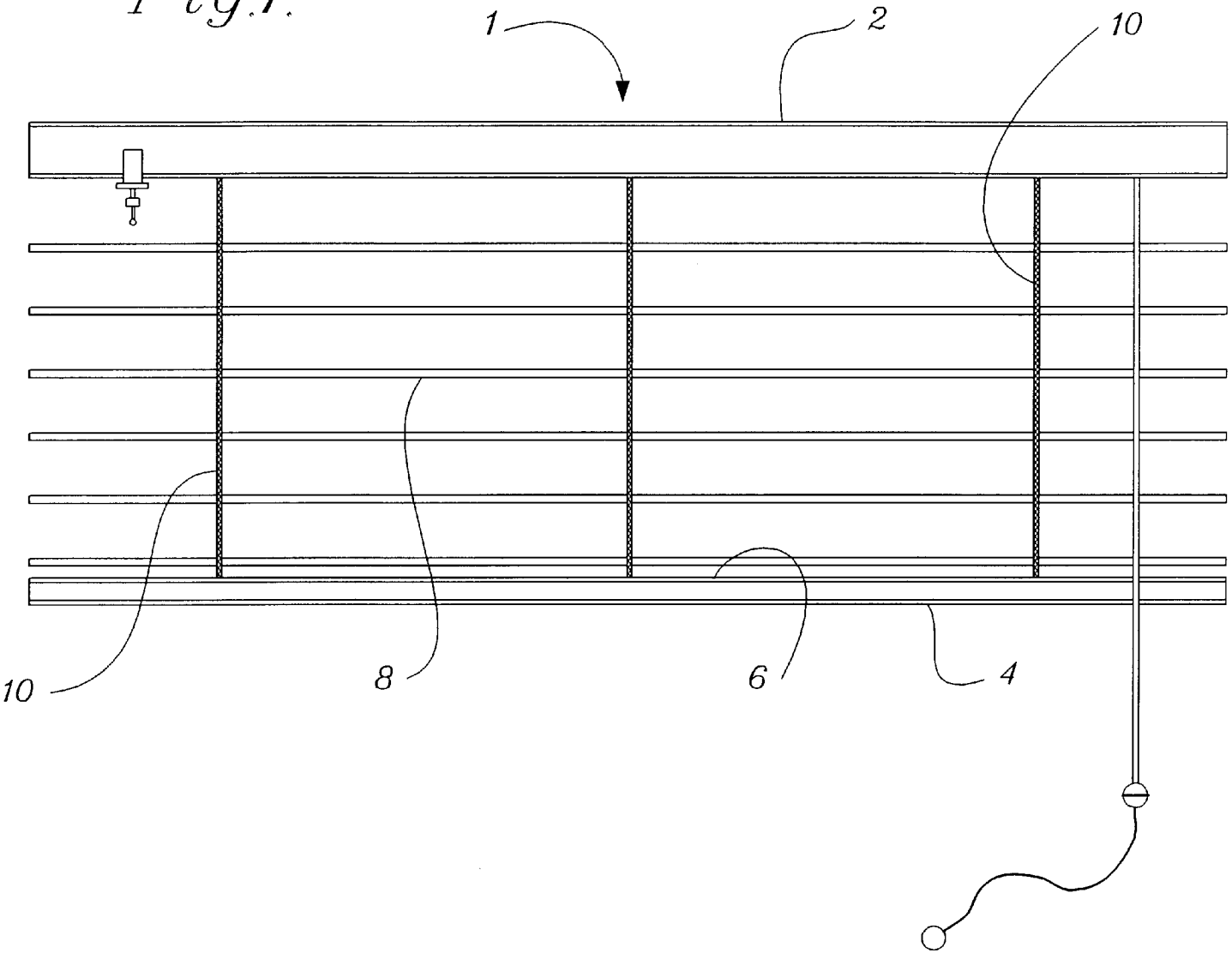
FIG. 1 is a side elevational view of the first preferred embodiment showing the venetian blind in the open position.
Figure 2:
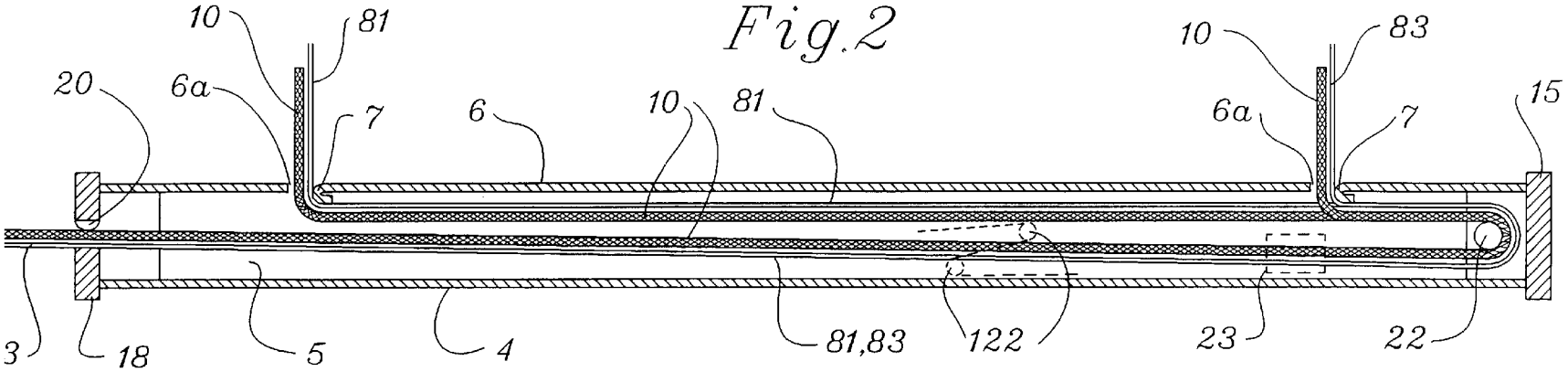
FIG. 2 is a front view of the first preferred embodiment of our bottomrail with the front portion of the bottomrail cut-away.

As shown in FIGS. 1 and 2, a venetian blind 1 containing the first preferred embodiment of our length adjustable bottomrail is comprised of a headrail 2, a length adjustable bottomrail 4 and a set of slats 8 extending therebetween. Lift cords 81 and 83 are provided adjacent each ladder 10 to raise and lower the blind. 1 prefer to use pairs of lift cords where one lift cord is adjacent to each ladder rail. Those lift cords may be passed through or around the ladder rungs. A one piece bottomrail or two piece bottomrail may be used. Only six slats are shown in the embodiment shown in FIG. 1. However, a greater number of slats would likely be utilized in a venetian-type blinds. The bottomrail has a cover 6 with slotted openings 6*a* through which each cord type ladder 10 may pass. Each opening preferably has one long rolled edge 7 to provide a turning surface against which a ladder 10 can slide smoothly as the ladder length is adjusted vertically, by taking up any excess ladder inside the hollow space 5 within the bottomrail 4. If desired, a roller (not shown) could be substituted for rolled edge 7. The ladders 10 and lift cords 81, 83 are routed transversely through the bottomrail, around a roller 22 attached to one endcap 15 and back to the clamp 20 contained in the opposite endcap 18. This clamp 20 functions as a releasable ladder and lift cord retainer. If desired, the ladders and lift cords could be attached to a common tie-off slide 23 shown in dotted line. Then, a single pull cord indicated by reference number 14 and a dotted lead line would run from the tie off slide 23 through clamp 20. The clamp preferably is spring biased toward a clamping position. To shorten the blind one would remove a selected number of slats from immediately above the bottomrail. This can be done by cutting the rungs which carry the slats. Then, one would pull the ladders 10 with lift cords 81 and 83 or pull cord 14 through the clamp 20 until the blind has reached the desired length. The excess cord or ladders that have been pulled through the clamp are then cut away or tucked back into the bottomrail. A track may be provided in the bottomrail for the slide. If desired, additional rollers 122 can be provided within the bottomrail to increase the length of travel of the ladders or the pull cord within the bottomrail. The excess slats can be stacked on the bottomrail, removed and stored within the bottomrail or removed from the blind.

The embodiment shown in FIG. 2 can be used for blinds having a double bottomrail. In that situation the front rails of the ladders would run through the front bottomrail and the rear rails of the ladders would run through the rear bottomrail. To shorten the blind one would cut the rungs which carried these slats and remove the selected slats. Then the ladder rails can be pulled through each of the front bottomrail and the rear bottomrail and associated clamps. The excess ladders would then be cut away.

The embodiment shown in FIG. 2 could also be used for blinds having lift cords that pass through route holes in the slats rather than adjacent the front edge or rear edge of the slats. To shorten such blinds the lift cords must be detached from the bottomrail or possibly even pulled through the headrail and all the slats so that the selected number of slats immediately above the bottomrail can be removed. After those slats are removed the ladder is shortened in the manner previously described and the lift cords are reattached.

Existing hollow bottomrails can be easily converted into an adjustable bottomrail like that shown in FIG. 2 by replacing the endcaps with endcap 15 having a roller 22 and endcap 18 having a clamp 20. It may also be necessary to provide a turning surface such as a roller or rolled edge at those locations where each ladder goes into the bottomrail.

Figure 3:
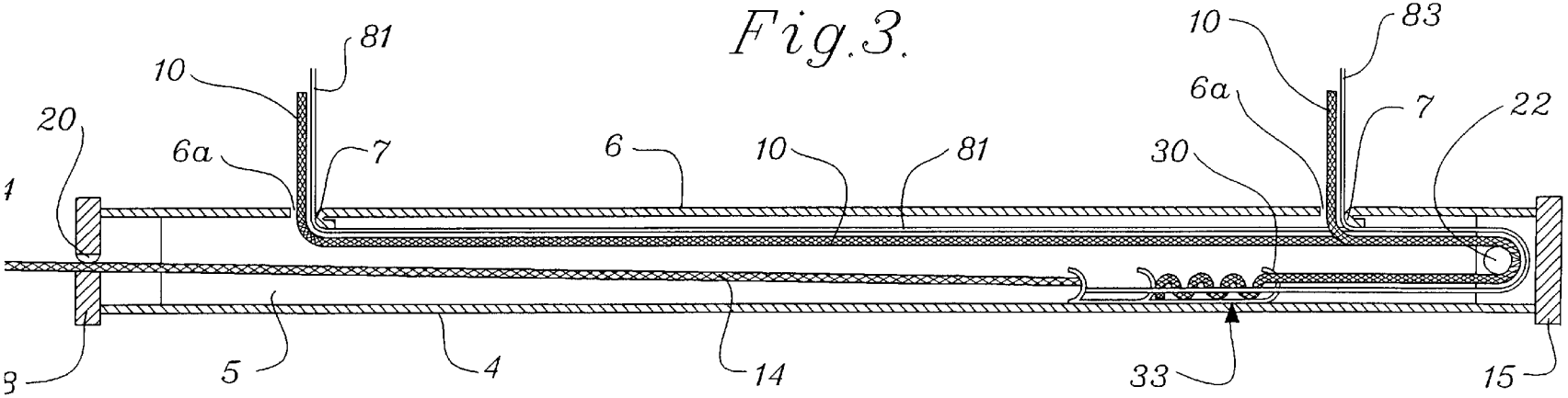
FIG. 3 is a front view similar to FIG. 2 of a second preferred embodiment of our bottomrail.
Figure 4:
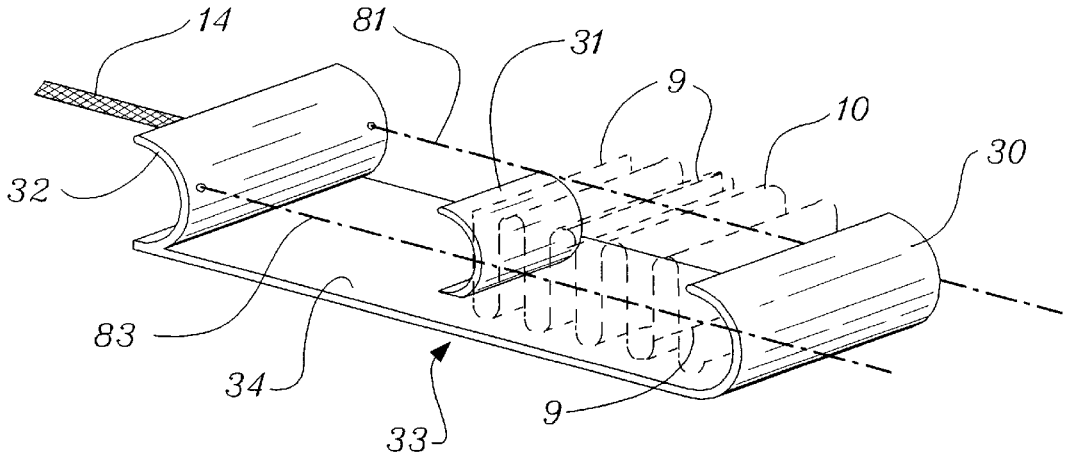
FIG. 4 is a perspective view of the slide in the embodiment of FIG. 3.

A second present preferred embodiment shown in FIGS. 3 and 4 uses a carrier having a hook. This carrier or slide 33 has a base 34 which carries a front hook 30, center hook 31 and rear 32 which also may be hook shaped. The distance between hooks 30 and 31 preferably is less than the distance between the rungs 8 in ladders 10. Additional hooks at closer spacings could be provided. The ladder 10 shown in chain line in FIG. 4 passes around front hook 30 and center hook 31 so that a rung 9 is retained behind each of them. The lift cords are fastened to the rear 32. A pull cord 14 extends from the rear through clamp 20 in endcap 18. The hooks 30 and 31 retain the ladder on the slide 33 and permit gross adjustment. Fine adjustment is made by pulling cord 14 through clamp 20. A track may be provided in the bottomrail to carry the slide 33.

Figure 6:
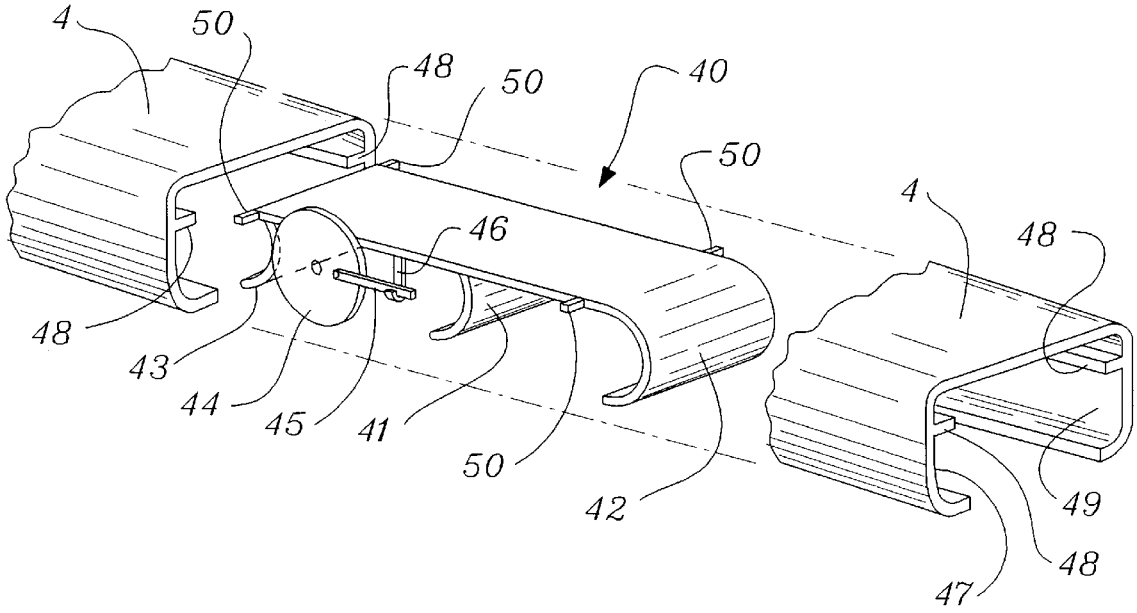
FIG. 6 is a perspective view of the slide used in the embodiment of FIG. 5.
Figure 5:
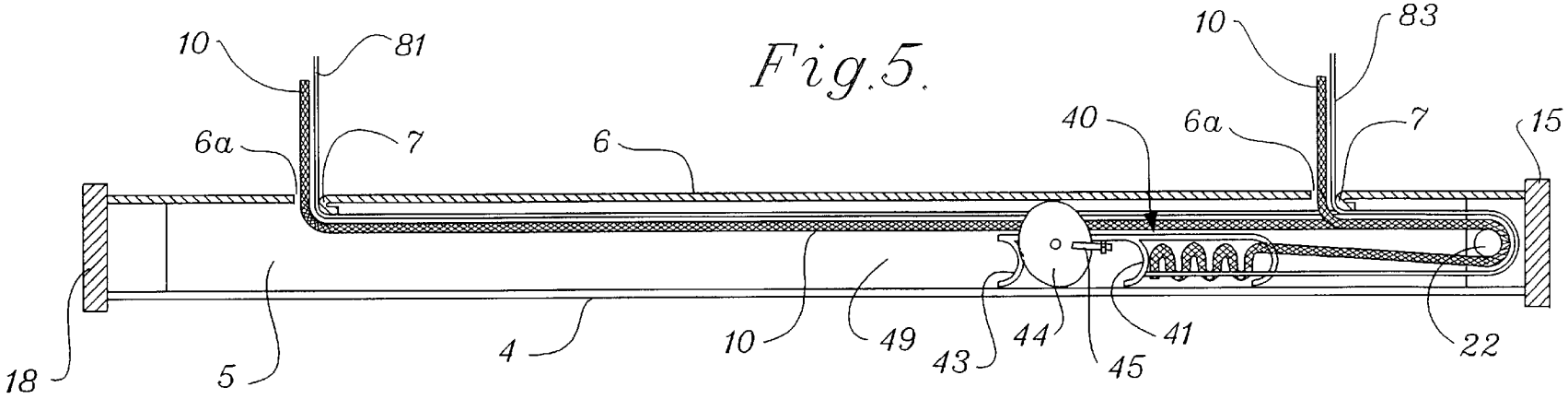
FIG. 5 is a front view similar to FIG. 2 of a third preferred embodiment.

A third embodiment shown in FIGS. 5 and 6 uses a slide 40 similar to the slide in the second embodiment. This slide 40 has a front hook 42 and center hook 41 which hold the ladder rungs as in the previous embodiment and a back 43 to which the lift cords are attached. The slide has pins 50 which ride in a track 48 on the inside of the side walls 47 and 49 of the bottomrail 4. This bottomrail has an open bottom. A cam lock is provided on the slide by cam 44 from which arm 45 extends and is releasably held by retainer 46. When the cam 44 is in the position shown in FIG. 6 it will press against the side 47 of the bottomrail to retain the slide in place. To release the slide, arm 45 is released and pulled downward thereby turning the cam 44. When the slide 40 is moved to the desired position to shorten the ladders arm 45 is replaced in retainer 46 to lock the slide in place.

Figure 7:
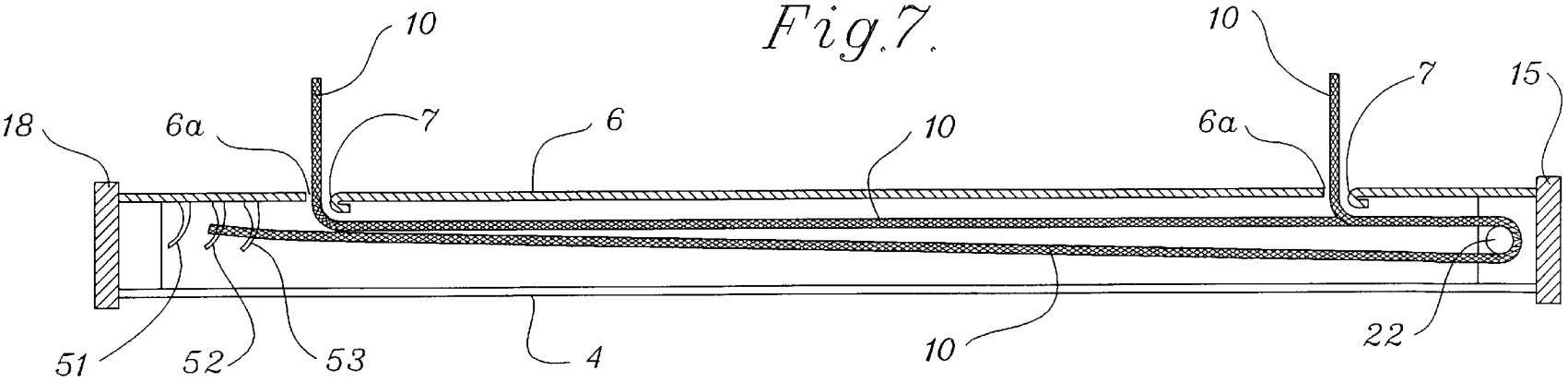
FIG. 7 is a front view similar to FIG. 2 of a fourth preferred embodiment.

Another embodiment shown in FIG. 7 contains a series of hooks attached to the underside of the top 6 and the bottomrail. This bottomrail can have an open bottom and the top 6 can be removable. The ladders loop around roller 22 and are held by the hooks 51, 52 and 53. To shorten the blind one pulls the ladders through the bottomrail around roller 22 and fastens a rung or rungs of each ladder to a selected hook or hooks.

Although we have shown certain present preferred embodiments of our length adjustable bottomrail, it should be distinctly understood that the invention is not limited thereto but may be variously embodied within the scope of the following claims.

We claim:

1. A venetian type blind comprising:

a. a headrail;

b. a first ladder having opposite cord type rails and rungs extending therebetween, the first ladder extending from the headrail;

c. at least one lift cord laced through the rungs of the first ladder and passing through the headrail;

d. a second ladder having opposite cord type rails and rungs extending therebetween, the second ladder extending from the headrail;

e. at least one lift cord laced through the rungs of the second ladder and passing through the headrail;

f. a plurality of slats each slat resting on a rung of the first ladder and a rung of the second ladder;

g. a bottomrail comprising:

i. a hollow elongated body having a length and at least one opening such that the ladders pass through the at least one opening and into the elongated body;

ii. at least one retainer within the bottomrail sized and positioned so that at least one ladder can be held by the retainer so that a portion of the ladder can be moved into and along the length of the body and be held within the elongated body to shorten that portion of the ladder between the headrail and the bottomrail, and the ladder can be released from the retainer and moved from within the bottomrail to lengthen that portion of the ladder between the headrail and the bottomrail.

2. The venetian type blind of claim 1 wherein the retainer is a clamp through which the first ladder passes.

3. The venetian type blind of claim 1 wherein the retainer is moveable within the bottomrail.

4. The Venetian type blind of claim 3 also comprising a pull cord attached to the retainer which pull cord extends through a pull cord opening provided in the elongated body.

5. The venetian type blind of claim 4 wherein the elongated body has opposite ends and the pull cord opening is provided at one of the opposite ends.

6. The venetian type blind of claim 4 also comprising at least one pulley within the bottomrail over which the pull cord passes.

7. The venetian type blind of claim 1 wherein the elongated body has a removable top and the retainer is attached to the removable top.

8. The venetian type blind of claim 1 wherein the retainer has a release position and a gripping position and is spring biased to a gripping position.

9. The venetian type blind of claim 1 wherein an opening is provided in the bottomrail for each ladder and the ladder passes through that opening before being held by the retainer.

10. The venetian type blind of claim 9 also comprising a roller attached to the bottomrail at each opening.

11. The venetian type blind of claim 1 wherein the retainer is a hook.

12. The venetian type blind of claim 1 also comprising a carrier connected to the bottomrail in a manner so as to be capable of sliding along a portion of the length of the body and the hook is attached to the carrier.

13. The venetian type blind of claim 12 also comprising a post attached to the carrier and to which post at least one of the lift cords is attached.

14. The venetian type blind of claim 12 also comprising a cam lock attached to the carrier.

15. The venetian type blind of claim 1 wherein the elongated body has an open top which provides the opening for each ladder.

16. The venetian type blind of claim 1 wherein the elongated body has an open bottom.

17. The venetian type blind of claim 1 wherein there are a pair of lift cords laced through the rungs of the first ladder and a second pair of lift cords laced through the rungs of the second ladder.

18. The Venetian type blind of claim 1 also comprising at least one post within and attached to the body and to which at least one lift cord is attached.

19. The venetian type blind of claim 1 also comprising an endcap attached to the body and to which at least one lift cord is connected.

20. The venetian type blind of claim 19 also comprising a roller attached to the endcap over which at least one lift cord passes.

21. The venetian type blind of claim 1 wherein the rungs of the ladders are equally spaced a selected distance from one another and the retainer is a plurality of hooks spaced apart from one another a distance which is less than the selected distance.

* * * * *